United States Patent [19]

Ohna

[11] Patent Number: 4,700,667

[45] Date of Patent: Oct. 20, 1987

[54] INTERNAL COMBUSTION ENGINE

[76] Inventor: Bernt E. Ohna, Broveien 15, N-1315 Nesoya, Norway

[21] Appl. No.: 802,215

[22] Filed: Nov. 26, 1985

[30] Foreign Application Priority Data

Dec. 5, 1984 [NO] Norway ..... 842280

[51] Int. Cl.[4] ..... F02B 75/16

[52] U.S. Cl. ..... 123/61 R; 123/47 AA

[58] Field of Search ..... 123/61 R, 61 V, 47

[56] References Cited

U.S. PATENT DOCUMENTS

| | | | |
|---|---|---|---|
| 1,010,754 | 12/1911 | Hall | 123/47 AA |
| 2,407,790 | 9/1946 | Tourneau | 123/46 R |
| 2,811,958 | 11/1957 | Roush, Jr. | 123/46 R |
| 3,386,425 | 6/1968 | Morsell | 123/61 R |
| 3,610,215 | 10/1971 | Carter | 123/46 R |

FOREIGN PATENT DOCUMENTS

| | | | |
|---|---|---|---|
| 15858 | 4/1912 | Denmark | 123/61 R |
| 806920 | 6/1951 | Fed. Rep. of Germany . | |
| 1451683 | 2/1969 | Fed. Rep. of Germany . | |
| 1451679 | 9/1969 | Fed. Rep. of Germany . | |
| 1601333 | 5/1970 | Fed. Rep. of Germany . | |
| 3029287 | 3/1982 | Fed. Rep. of Germany . | |
| 3229940 | 6/1984 | Fed. Rep. of Germany . | |
| 3315052 | 10/1984 | Fed. Rep. of Germany . | |
| 1228616 | 8/1960 | France . | |
| 2438164 | 4/1980 | France . | |
| 414810 | 8/1980 | Sweden . | |
| 421610 | 4/1967 | Switzerland . | |
| 640600 | 1/1984 | Switzerland . | |
| 411404 | 6/1934 | United Kingdom | 123/61 R |
| 927633 | 5/1963 | United Kingdom . | |

*Primary Examiner*—Craig R. Feinberg

*Attorney, Agent, or Firm*—Young & Thompson

[57] ABSTRACT

A two-stroke internal combustion engine having at least two cylinders which are aligned, each cylinder having a piston. The pistons are rigidly attached to each other by means of a piston rod which is provided with a carrier and exhaust valves, the valves being slidably arranged on the piston rod, and exhaust ducts which are provided for each cylinder at the ends facing each other. The facing ends also having valve seats. Intake ports having pressure controlled check valves are provided in each cylinder at the distal ends, and each combustion chamber is on the side of the piston which faces the other piston. The exhaust ducts are arranged in a guide for the common piston rod.

5 Claims, 1 Drawing Figure

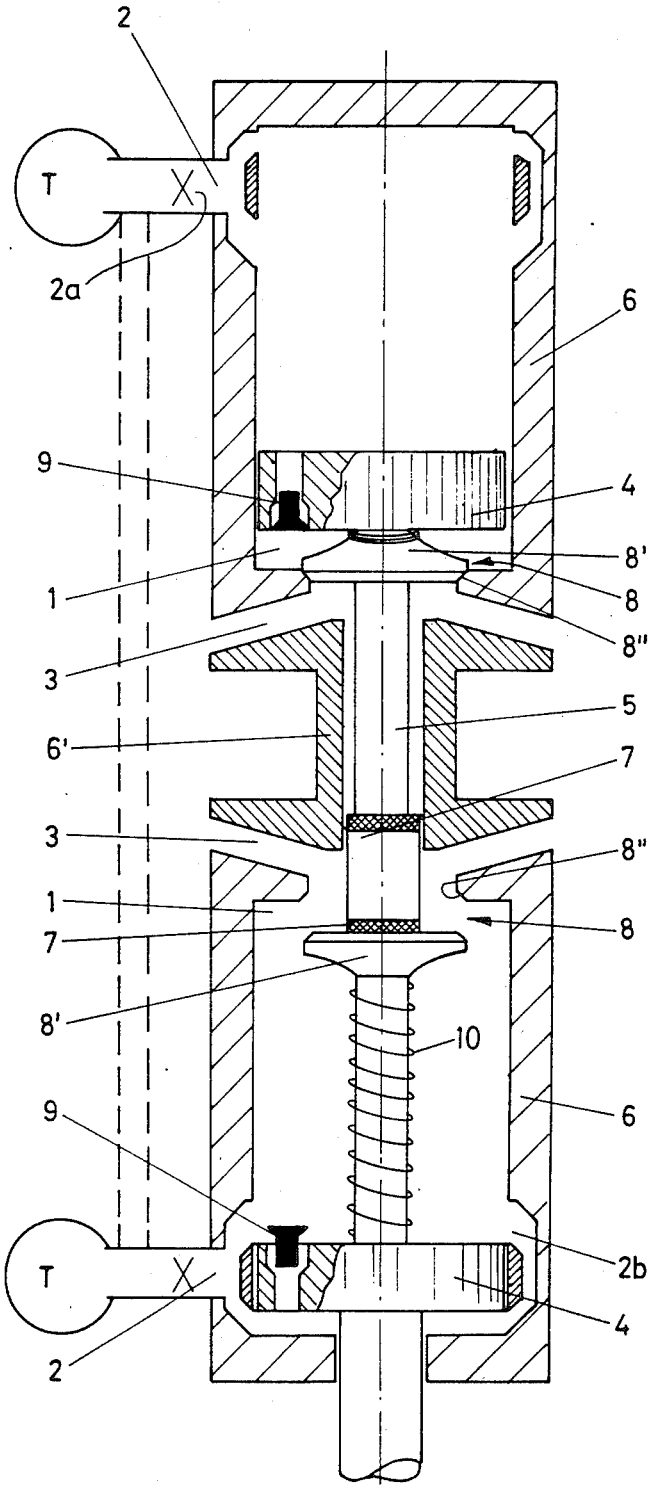
2
T
2a
6
9
4
8'
1
8
8"
3
5
6'
7
3
8"
1
8
7
8'
10
6
9
2b
T
4
2

INTERNAL COMBUSTION ENGINE

The present invention concerns an internal combustion engine, more particularly a piston engine of the type disclosed in the introduction to the subsequent independent claim 1.

Primarily, the engine is intended for use in operations requiring a reciprocating motion, such as a hydraulic pump, a piston compressor, foil etc. but it can also be used to transfer the reciprocating motion to a rotating motion by means of a conventional crank mechanism.

Internal combustion engines in various designs have been suggested to a relatively large extent, even if not all have found practical application for various reasons, such as high production costs, many moveable parts, high fuel consumption, poor efficiency, extensive space requirements etc.

According to Swiss Patent Publication No. 640.600 an engine is, admittedly, known which overcomes some of the above-mentioned drawbacks. The engine has two moveable pistons which are rigidly attached to each other by means of a piston rod. However, said engine has been provided with combined scavenge pistons and valves on the piston rod. On ignition in one of the combustion chambers, the piston and the scavenge piston are pushed in the same direction. When the piston reaches the exhaust ports in the cylinder wall, the piston rod opens up ducts for scavenging with the air/fuel mixture, this being a form of cross-scavenging. The flow section for the scavenging mixture is very limited, however, while the scavenging pressure seems too low, combined with a short time lapse for opening between the valve effective parts, which leads to poor gas exchange and lower efficiency. Also, the negative pressure built up on one side of the scavenge piston seems very restricted, so that the supply of fresh charge will be negligible.

The object of the present invention is to provide an engine of simple construction with few moveable parts, a high degree of efficiency, low fuel consumption, and limited space requirements, where also the above-mentioned disadvantages according to the prior art are avoided. This is achieved by means of two moveable pistons which are rigidly attached to each other by means of a piston rod, which rod, according to the invention, is provided with a carrier and exhaust valves, said valves being provided slideably on the piston rod, and exhaust ducts which are provided for each cylinder at the ends facing each other. These ends also have valve seats. The cylinders are also provided with intake ducts where pressure controlled check valves have been placed, the ducts leading into intake ports which have been arranged in each cylinder at the ends turned away from each other. Each of the combustion chambers pertaining to the engine are on the side of the piston which faces the other piston. The pistons may be provided with one or more valves in order to increase the charge supply further. It is advantageous to have the intake ducts of the engine connected to an overcharging device, however, this is not essential. At the same time, the pistons themselves are acting as scavenge pistons, the scavenging being longitudinal scavenging with good control of the gas exchange process.

The engine will be described in more detail in the following with reference to an embodiment example of the invention, shown in the drawing, the drawing showing a section through the longitudinal axis of the engine.

Sealing devices, manifolds etc. have not been represented.

The engine has two cylinders 6 which are aligned. In each of the cylinders there is a moveable piston 4, said pistons being rigidly attached to each other through a piston rod 5, a carrier 7 being attached to the piston rod 5. The valve head 8' of the exhaust valves 8 communicable with exhaust ducts 3 is slideably arranged on the piston rod 5. Each exhaust valve head 8' can be seated against a valve seat 8'' which is arrranged at the end of a cylinder 6 that faces the other cylinder 6. The exhaust valve head 8' has devices (not represented in the drawing) for temporarily locking the valve head 8' to the piston rod 5, for instance by means of a per se known spring catch action device which may consist of a spring-loaded ball held in the valve head and co-acting with a groove along the circumference of the piston rod. In this way, the valve head 8' is held in a certain position on the piston rod 5 until the parts are mutually exposed to a force sufficiently strong to push the ball out of engagement with the groove, thereby freeing the valve to move relative to the rod. As an alternative way of keeping the valve in a desired position, a suitable spring 10 may be arranged between the piston 4 and the valve head 8'. Moreover, the engine is provided with intake ducts 2 having check valves **2*a*, each duct leading into an annular chamber 2*b* at the ends of the cylinders not facing each other. The combustion chambers pertaining to the engine have been marked 1. The pistons 4 may be provided with one or more valves 9** in order to improve the charge supply to the combustion chamber should the engine be overcharged. The pressure built up in the engine, causing the reciprocating motion of the pistons, may be taken out as output at B.

In one of the end positions of the pistons (as shown in the drawing), the exhaust valve head 8' seals against the valve seat 8'' principally because of the compression pressure exerted on the valve. In the alternative embodiment the spring 10 assists in pressing the valve 8 against the valve seat 8''. In this position a compressed air/fuel mixture is ignited in one of the combustion chambers 1, driving the piston 4, the piston rod 5 and the carrier 7 upwards. The check valve **2*a* in the intake duct 2 will be closed. The exhaust valve 8 remains closed until the carrier engages with the valve head 8' and pushes this from the valve seat 8'', thereby opening for discharge of the combustion products. The medium over the piston 4 is compressed until the piston passes the intake duct 2, and subsequently escapes to the underside of the piston via the annular chamber 2*b*, assisting to drive the combustion product out through the open exhaust valve 8 in the exhaust ducts 3. At the same time, the valve 2*a* in the intake duct is opened for supply of fresh charge to the cylinder 6. The fresh charge is supplied to the combustion chamber 1 until the piston 4 again passes the intake duct 2 on its way down. In the case of overcharging, if the piston 4 is provided with refill valves 9**, these will be open until the compression pressure exceeds the charge pressure. The charge is compressed until the piston unit reaches its end position ready for a new work sequence.

The lower piston works correspondingly, except that the working stroke starts when the other piston has gas exchange. In this manner, the engine acts according to the two-stroke principle.

It is significant that the engine can function through its work cycle without any extra devices such as counterbalancing devices like for instance flywheels, counterweights etc.

Having described my invention, I claim:

1. In a two-stroke internal combustion engine comprising at least two aligned cylinders, each said at least two aligned cylinders having facing proximate ends and remote distal ends, each said cylinder further housing a movable piston having proximate and distal faces, each piston being aligned as a pair rigidly interconnected by a piston rod, the improvement comprising: a carrier fixed to said piston rod, said carrier operating exhaust valve heads opening and closing exhaust valves formed at said proximate end of each said cylinder alternatingly, said proximate end of each said cylinder further comprising a valve seat for engagement with said valve head, each said cylinder further comprising intake ports at said distal end thereof, said intake ports having pressure controlled check valves, said engine having a combustion chamber formed between each said proximate cylinder end and its corresponding proximate piston face; wherein as each said piston approaches the corresponding distal end of its respective cylinder, said carrier lifts the corresponding valve head from its valve seat.

2. Engine according to claim 1, and an annular chamber formed in each said cylinder distal end, said annular chamber communicating with said check valves, said annular chamber placing said proximate and distal ends of its corresponding said cylinder in communication when the corresponding said piston is disposed at said distal end.

3. Engine according to claim 1, said pressure controlled check valves closing when pressure in the corresponding said cylinder is greater than that in the corresponding said intake ports, said check valves opening when pressure inside said intake ports exceeds that in said cylinder.

4. Engine according to claim 1, wherein each said piston comprises at least one valve regulating combustion pressure.

5. Engine according to claim 1, and a spring disposed between each said piston and its corresponding slidably mounted exhaust valve head.

* * * * *